US011560604B2

(12) United States Patent
Ishii et al.

(10) Patent No.: US 11,560,604 B2
(45) **Date of Patent: *Jan. 24, 2023**

(54) FERRITIC STAINLESS STEEL

(71) Applicant: JFE Steel Corporation, Tokyo (JP)

(72) Inventors: Tomohiro Ishii, Tokyo (JP); Mitsuyuki Fujisawa, Tokyo (JP); Reiko Sugihara, Tokyo (JP); Chikara Kami, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 160 days.

This patent is subject to a terminal disclaimer.

(21) Appl. No.: 16/497,507

(22) PCT Filed: May 25, 2017

(86) PCT No.: PCT/JP2017/019514

§ 371 (c)(1),
(2) Date: Sep. 25, 2019

(87) PCT Pub. No.: WO2018/179456

PCT Pub. Date: Oct. 4, 2018

(65) Prior Publication Data

US 2021/0277494 A1 Sep. 9, 2021

(30) Foreign Application Priority Data

Mar. 30, 2017 (JP) ..... JP2017-068023

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/004* (2013.01); *C21D 6/005* (2013.01); *C21D 6/007* (2013.01);
(Continued)

(58) Field of Classification Search
CPC .... C21D 9/46; C21D 2211/005; C21D 6/002; C22C 38/52; C22C 38/54; C22C 38/001;
(Continued)

(56) References Cited

U.S. PATENT DOCUMENTS 6,426,039 B2 * 7/2002 Hirasawa ..... C22C 38/001 420/38
7,806,993 B2 10/2010 Miyazaki et al.
(Continued)

FOREIGN PATENT DOCUMENTS

CN 1522311 A 8/2004
CN 101171353 A 4/2008
(Continued)

OTHER PUBLICATIONS

NPL: on-line translation of JP-2013209705-A, Oct. 2013 (Year: 2013).*
(Continued)

*Primary Examiner* — Jie Yang
(74) *Attorney, Agent, or Firm* — RatnerPrestia

(57) ABSTRACT

Provided is a ferritic stainless steel in which cracking is unlikely to be caused in the vicinity of a weld zone by the stress due to expansion, contraction, and deformation due to the thermal effect of welding in the case of performing welding after deep drawing and which is excellent in corrosion resistance in the vicinity of the weld zone.
The ferritic stainless steel has a composition containing C: 0.001% to 0.020%, Si: 0.01% to 0.30%, Mn: 0.01% to 0.50%, P: 0.04% or less, S: 0.01% or less, Cr: 18.0% to 24.0%, Ni: 0.01% to 0.40%, Mo: 0.30% to 3.0%, Al: 0.01% to 0.15%, Ti: 0.01% to 0.50%, Nb: 0.01% to 0.50%, V: 0.01% to 0.50%, Co: 0.01% to 6.00%, B: 0.0002% to 0.0050%, and N: 0.001% to 0.020% on a mass basis, the
(Continued)

(a) REMOVING EAR AFTER DEEP DRAWING (b) BORING BOTTOM AND WELDING OPENING PORTION remainder being Fe and inevitable impurities. The composition satisfies 0.30%≤Ti+Nb+V≤0.60%.

5 Claims, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.
CPC ..... *C21D 6/008* (2013.01); *C21D 8/0205* (2013.01); *C21D 8/0226* (2013.01); *C21D 8/0236* (2013.01); *C22C 38/002* (2013.01); *C22C 38/005* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/005* (2013.01)

(58) Field of Classification Search
CPC ..... C22C 38/02; C22C 38/04; C22C 38/06; C22C 38/44; C22C 38/46; C22C 38/48; C22C 38/50
USPC ..... 148/325
See application file for complete search history.

(56) References Cited

U.S. PATENT DOCUMENTS

| | | | | |
|---|---|---|---|---|
| 10,763,517 | B2 * | 9/2020 | Yano | C21D 9/46 |
| 11,261,512 | B2 * | 3/2022 | Ichikawa | C22C 38/004 |
| 2002/0007876 | A1 * | 1/2002 | Hirasawa | C22C 38/44 420/38 |
| 2014/0023432 | A1 * | 1/2014 | Matsuhashi | C22C 38/44 403/272 |
| 2015/0292068 | A1 | 10/2015 | Teraoka et al. | |
| 2016/0002760 | A1 | 1/2016 | Hiraide et al. | |
| 2019/0106775 | A1 | 4/2019 | Nishida et al. | |
| 2019/0177825 | A1 | 6/2019 | Yano et al. | |
| 2019/0296369 | A1 * | 9/2019 | Yano | H01M 8/0254 |
| 2019/0305328 | A1 | 10/2019 | Yano et al. | |
| 2019/0368001 | A1 | 12/2019 | Kamo et al. | |
| 2019/0376157 | A1 | 12/2019 | Kamo et al. | |
| 2020/0002779 | A1 | 1/2020 | Yoshino et al. | |
| 2020/0080181 | A1 | 3/2020 | Ichikawa et al. | |
| 2020/0157646 | A1 | 5/2020 | Eguchi et al. | |
| 2020/0216936 | A1 | 7/2020 | Kamo et al. | |

FOREIGN PATENT DOCUMENTS

| | | | | |
|---|---|---|---|---|
| EP | 1493831 | A1 | | 1/2005 |
| EP | 2799577 | A1 | | 11/2014 |
| JP | 2000144258 | A | | 5/2000 |
| JP | 2001355048 | A | | 12/2001 |
| JP | 2002030346 | A | | 1/2002 |
| JP | 2003138349 | A | | 5/2003 |
| JP | 2003201547 | A | | 7/2003 |
| JP | 2005154862 | A | | 6/2005 |
| JP | 2007119847 | A | | 5/2007 |
| JP | 2009299116 | A | | 12/2009 |
| JP | 2011179063 | A | | 9/2011 |
| JP | 2013209705 | A | * | 10/2013 |
| JP | 2015096648 | A | | 5/2015 |
| JP | 2015124419 | A | * | 7/2015 |
| JP | 2015124420 | A | | 7/2015 |
| JP | 2016156072 | A | | 9/2016 |
| JP | 2016199803 | A | | 12/2016 |
| JP | 2017101267 | A | | 6/2017 |
| WO | 9703216 | A1 | | 1/1997 |

OTHER PUBLICATIONS

NPL: on-line translation of JP-2015124419-A, Jul. 2015 (Year: 2015).*
International Search Report and Written Opinion for International Application No. PCT/JP2017/019514, dated Aug. 29, 2017—7 pages.
Chinese Office Action for Chinese Application No. 201780089128.1, dated Nov. 15, 2020 with Concise Statement of Relevance of Office Action, 11 pages.
Extended European Search Report for European Application No. 17904332.8, dated Dec. 16, 2019, 6 pages.
Korean Office Action for Korean Application No. 10-2019-7027901, dated Feb. 1, 2021 with Concise Statement of Relevance of Office Action, 4 pages.
Korean Office Action for Korean Application No. 10-2019-7027901, dated Jul. 2, 2021 with Concise Statement of Relevance of Office Action, 5 pages.
Korean Office Action for Korean Application No. 10-2019-7027901, dated Sep. 7, 2021, with Concise Statement of Relevance of Office Action, 4 pages.
Non Final Office Action for U.S. Appl. No. 16/325,577, dated Aug. 7, 2020, 28 pages.
Non Final Office Action for U.S. Appl. No. 16/325,577, dated Aug. 2, 2021, 32 pages.
Final Office Action for U.S. Appl. No. 16/325,577, dated Jan. 22, 2021, 27 pages.
Korean Office Action for Korean Application No. 10-2019-7027901, dated Sep. 21, 2022 with Concise Statement of Relevance of Office Action, 15 pages.

* cited by examiner

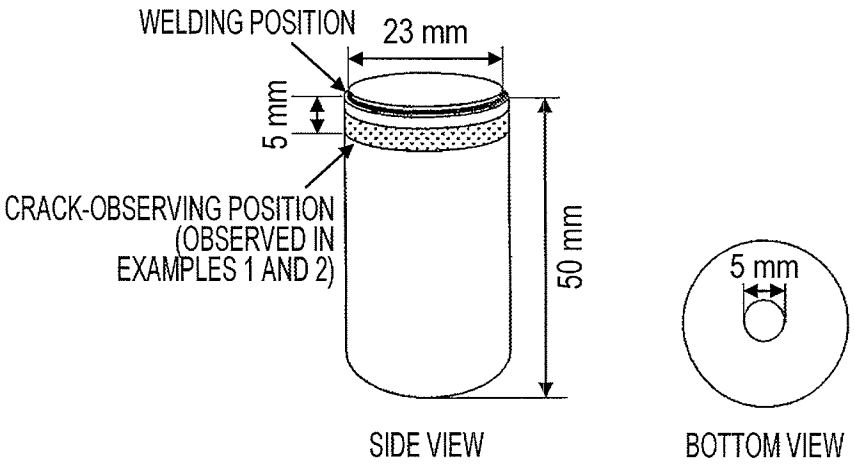
(b) BORING BOTTOM AND WELDING OPENING PORTION
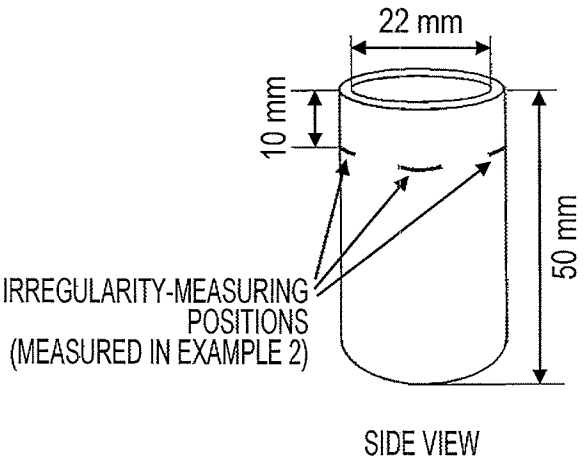
(a) REMOVING EAR AFTER DEEP DRAWING

FERRITIC STAINLESS STEEL

CROSS REFERENCE TO RELATED APPLICATIONS

This is the U.S. National Phase application of PCT/JP2017/019514, filed May 25, 2017, which claims priority to Japanese Patent Application No. 2017-068023, filed Mar. 30, 2017, the disclosures of these applications being incorporated herein by reference in their entireties for all purposes.

FIELD OF THE INVENTION

The present invention relates to a ferritic stainless steel which is suitable for use in manufacturing structures joined by welding after deep drawing and which is excellent in weld shape and corrosion resistance.

BACKGROUND OF THE INVENTION

Hitherto, ferritic stainless steels have been inferior in press formability to austenitic stainless steels and high-tensile strength steel sheets and the use thereof for applications requiring excellent press formability has been limited.

However, the improvement in formability of recent ferritic stainless steels, particularly the improvement in deep drawability, is remarkable and ferritic stainless steels are increasingly used for applications, requiring severe press working, including, for example, kitchen materials, electric device parts, and automotive parts.

Patent Literature 1 discloses a ferritic stainless steel sheet with excellent deep drawability. In the steel sheet, the deep drawability is improved in such a manner that the composition and production conditions of steel are controlled within an appropriate range, the average r-value of the finish-annealed steel sheet is set to 2.0 or more, the average grain size is set to 50 μm or less, and (tensile strength (MPa)×average r-value)/(grain size (μm)) is set to 20 or more.

Patent Literature 2 discloses a ferritic cold-rolled stainless steel sheet with excellent press formability. In this steel sheet, precipitation hardening by fine AlN is reduced by preventing the fine precipitation of AlN and the local elongation is increased by setting the ferrite grain size to less than 10 μm. Furthermore, in this literature, the uniform elongation is increased by setting the average grain size of Cr carbonitrides in ferrite grains to 0.6 μm or more, whereby the press formability is improved.

Patent Literature 3 discloses a ferritic stainless steel sheet with excellent deep drawability. In this steel sheet, the deep drawability is improved in such a manner that the average ferrite grain size is set to 40 μm or less and the percentage of ferrite grains, having a misorientation of 10° or less with respect to {111}//ND, in a cross section extending in the rolling direction and a thickness direction is set to 20% or more by adjusting hot rolling conditions.

However, the occurrence of longitudinal cracks caused by severe press forming cannot be sufficiently suppressed even if these ferritic stainless steel sheets, which have excellent press formability, are used.

Patent Literature 4 discloses a ferritic stainless steel sheet with excellent deep drawability, resistance to secondary working embrittlement, and corrosion resistance for the purpose of suppressing such longitudinal cracks. In this steel sheet, deep drawability and resistance to secondary working embrittlement are both achieved by setting the average grain size and surface roughness Ra of this steel sheet finish-annealed and pickled or further subjected to skin-pass rolling to 40 μm or less and 0.30 μm or less, respectively, in addition to adding appropriate amounts of Nb and/or Ti and appropriate amounts of B and V.

PATENT LITERATURE

PTL 1: Japanese Unexamined Patent Application Publication No. 2003-138349

PTL 2: Japanese Unexamined Patent Application Publication No. 2007-119847

PTL 3: Japanese Unexamined Patent Application Publication No. 2009-299116

PTL 4: Japanese Unexamined Patent Application Publication No. 2003-201547

SUMMARY OF THE INVENTION

However, even if the ferritic stainless steel sheet disclosed in Patent Literature 4 is used, cracks occurring in the vicinity of a weld zone in the case of performing welding particularly after press forming cannot be completely prevented.

In view of the above problems involved in the conventional techniques, it is an object according to aspects of the present invention to provide a ferritic stainless steel in which the occurrence of cracks in the vicinity of a weld zone caused by the stress due to expansion, contraction, and deformation, which are generated by the thermal effect of welding, is suppressed in the case of performing welding after deep drawing and which is excellent in corrosion resistance in the vicinity of the weld zone.

The inventors have investigated the relationship between the composition of a ferritic stainless steel and cracks in the vicinity of a weld zone, and corrosion resistance for the purpose of solving the above problems and have obtained Findings (1) to (3) below.

(1) In the case of welding a region in which the strength in grain boundaries is reduced due to deep drawing, cracks are caused in the vicinity of a weld zone by the stress due to the expansion and contraction induced in the vicinity of the weld zone by welding heat.

(2) The addition of Co reduces the thermal expansion coefficient and therefore reduces the expansion and contraction due to welding heat, thereby reducing the deformation of a weld zone and the stress in the vicinity of the weld zone. As a result, the occurrence of cracks in the vicinity of the weld zone is suppressed by the addition of Co.

(3) The addition of B prevents the reduction in strength of grain boundaries caused by deep drawing and therefore the occurrence of cracks is suppressed even if thermal stress is induced in the vicinity of a weld zone after deep drawing.

Aspects of the present invention are composed on the basis of the above results. That is, aspects of the present invention have a configuration as summarized below.

[1] A ferritic stainless steel has a composition containing C: 0.001% to 0.020%, Si: 0.01% to 0.30%, Mn: 0.01% to 0.50%, P: 0.04% or less, S: 0.01% or less, Cr: 18.0% to 24.0%, Ni: 0.01% to 0.40%, Mo: 0.30% to 3.0%, Al: 0.01% to 0.15%, Ti: 0.01% to 0.50%, Nb: 0.01% to 0.50%, V: 0.01% to 0.50%, Co: 0.01% to 6.00%, B: 0.0002% to 0.0050%, and N: 0.001% to 0.020% on a mass basis, the remainder being Fe and inevitable impurities, the composition satisfying the following formula:

$$0.30\% \leq Ti+Nb+V \leq 0.60\% \quad (1)$$

where the symbol of each element in Formula (1) represents the content (mass percent) of the element.

[2] In the ferritic stainless steel specified in Item [1], the content of Mo is 0.30% to 1.50%, the content of Ti is 0.25% to 0.40%, the content of Nb is 0.03% to 0.13%, the content of V is 0.02% to 0.13%, the content of Co is 0.02% to 0.30%, and the following formulas are satisfied:

$$Co/B: 10 \text{ to } 150 \quad (2)$$

$$Nb+V \leq 0.22\% \leq 0.22\% \quad (3)$$

where the symbol of each element in Formulas (2) and (3) represents the content (mass percent) of the element.

[3] In the ferritic stainless steel specified in Item [1] or [2], one, two or more of Zr: 1.0% or less, W: 1.0% or less, and REM: 0.1% or less is further contained on a mass basis.

In the case where a ferritic stainless steel according to aspects of the present invention is used to manufacture a structure joined by welding after deep drawing, the occurrence of cracks in the vicinity of a weld zone caused by the stress due to expansion, contraction, and deformation, which are generated by the thermal effect of welding, is suppressed and the obtained structure is excellent in corrosion resistance in the vicinity of the weld zone.

Since cracks are unlikely to occur in the vicinity of the weld zone, it can be said that the structure is excellent in weld shape.

BRIEF DESCRIPTION OF THE DRAWING

FIG. 1 is a schematic view illustrating a cylindrical deep drawing-shaped specimen.

DETAILED DESCRIPTION OF EMBODIMENTS OF THE INVENTION

Embodiments of the present invention are described below. The present invention is not limited to the embodiments below.

The composition of a ferritic stainless steel according to aspects of the present invention (first embodiment of the invention) contains C: 0.001% to 0.020%, Si: 0.01% to 0.30%, Mn: 0.01% to 0.50%, P: 0.04% or less, S: 0.01% or less, Cr: 18.0% to 24.0%, Ni: 0.01% to 0.40%, Mo: 0.30% to 3.0%, Al: 0.01% to 0.15%, Ti: 0.01% to 0.50%, Nb: 0.01% to 0.50%, V: 0.01% to 0.50%, Co: 0.01% to 6.00%, B: 0.0002% to 0.0050%, and N: 0.001% to 0.020% on a mass basis, the remainder being Fe and inevitable impurities, and satisfies the following formula:

$$0.30\% \leq Ti+Nb+V \leq 0.60\% \quad (1)$$

where the symbol of each element in Formula (1) represents the content (mass percent) of the element.

The composition of the ferritic stainless steel according to aspects of the present invention (first embodiment of the invention) may further contain one, two or more of Zr: 0.5% or less, W: 1.0% or less, and REM: 0.1% or less on a mass basis.

The composition of the ferritic stainless steel according to aspects of the present invention (first embodiment of the invention) is described below in detail. Incidentally, % used to express the content of each element refers to mass percent unless otherwise specified.

C: 0.001% to 0.020%

Increasing the content of C improves the strength and reducing the C content improves the workability. In order to obtain adequate strength, it is appropriate to contain 0.001% or more. However, when the C content is more than 0.020%, the deterioration of workability is significant, which is not suitable for deep drawing. Thus, the C content is set to 0.001% to 0.020%. The lower limit thereof is preferably 0.002% or more, more preferably 0.003% or more, and further more preferably 0.004% or more.

The upper limit thereof is preferably 0.018% or less, more preferably 0.015% or less, and further more preferably 0.014% or less. In addition, when C only is inevitably contained and the C content is within the above range, C need not be positively added.

Si: 0.01% to 0.30%

Si is an element useful for deoxidation. An effect thereof is obtained by containing 0.01% or more. However, when the content of Si is more than 0.30%, the deterioration of workability is significant, which is not suitable for deep drawing. Thus, the Si content is set to 0.01% to 0.30%. The lower limit thereof is preferably 0.05% or more, more preferably 0.08% or more, and further more preferably 0.11% or more. The upper limit thereof is preferably 0.20% or less, more preferably 0.18% or less, and further more preferably 0.16% or less.

Mn: 0.01% to 0.50%

Mn has the effect of improving the strength. The effect is obtained by containing 0.01% or more. However, excessively containing Mn significantly deteriorates the workability and is not suitable for deep drawing. Thus, the content of Mn is appropriately 0.50% or less. Hence, the Mn content is set to 0.01% to 0.50%. The lower limit thereof is preferably 0.03% or more, more preferably 0.05% or more, and further more preferably 0.11% or more.

The upper limit thereof is preferably 0.40% or less, more preferably 0.30% or less, and further more preferably 0.20% or less. Incidentally, Mn is inevitably contained in steel. Therefore, when the content of inevitably contained Mn is within the above range, Mn need not be added.

P: 0.04% or Less

P is an element which is inevitably contained in steel, which segregates at grain boundaries after deep drawing to reduce the strength of the grain boundaries, and which tends to cause intergranular cracking. Thus, the content of P is preferably low. From the viewpoint of obtaining an effect in accordance with aspects of the present invention, P need not be contained (the P content may be 0%). Therefore, the P content is set to 0.04% or less and is preferably 0.03% or less.

S: 0.01% or Less

S is an element which is inevitably contained in steel. When the content of S is more than 0.01%, the formation of water-soluble sulfides such as CaS and MnS is promoted, thereby deteriorating the corrosion resistance. From the viewpoint of obtaining an effect in accordance with aspects of the present invention, S needs not be contained (the S content may be 0%). Thus, the S content is set to 0.01% or less and is preferably 0.005% or less.

Cr: 18.0% to 24.0%

Cr is an element which is most important in determining the corrosion resistance of stainless steels. When the content of Cr is less than 18.0%, a stainless steel does not have sufficient corrosion resistance. In particular, the corrosion resistance of a weld zone is insufficient. However, excessively containing Cr deteriorates the workability and is not suitable for deep drawing. Therefore, the Cr content is appropriately 24.0% or less. Thus, the Cr content is set to 18.0% to 24.0%. The lower limit thereof is preferably 19.0% or more, more preferably 20.0% or more, and further more preferably 20.5% or more. The upper limit thereof is preferably 23.5% or less, more preferably 22.5% or less, further more preferably 22.0% or less, and still further more preferably 21.5% or less.

Ni: 0.01% to 0.40%

Ni is an element which improves the corrosion resistance of stainless steel and which suppresses the progress of corrosion in corrosive environments where active dissolution occurs because no passive film can be formed. An effect thereof is obtained by setting the content of Ni to 0.01% or more. However, when the Ni content is 0.40% or more, the workability deteriorates, which is not suitable for deep drawing. Thus, the Ni content is set to 0.01% to 0.40%. The lower limit thereof is preferably 0.03% or more, more preferably 0.07% or more, and further more preferably 0.11% or more.

The upper limit thereof is preferably 0.35% or less, more preferably 0.25% or less, and further more preferably 0.18% or less.

Mo: 0.30% to 3.0%

Mo is an element which improves the corrosion resistance of stainless steels by promoting the re-passivation of a passive film. When Mo is contained together with Cr, an effect thereof is more remarkable. The effect of improving the corrosion resistance by Mo is obtained when the content thereof is 0.30% or more. However, when the Mo content is more than 3.0%, the high-temperature strength increases, the rolling load increases, and therefore the manufacturability deteriorates. Thus, the Mo content is set to 0.30% to 3.0%. The lower limit thereof is preferably 0.40% or more, more preferably 0.50% or more, and further more preferably 0.60% or more. The upper limit thereof is preferably 2.0% or less, more preferably 1.8% or less, and further more preferably 1.5% or less. When excellent workability is necessary, the upper limit thereof is more preferably 0.90% or less.

Al: 0.01% to 0.15%

Al is an element useful for deoxidation. An effect thereof is obtained when the content of Al is 0.01% or more. However, when the Al content is more than 0.15%, the average grain size of ferrite is likely to increase and cracking is likely to occur in the vicinity of a weld zone. Thus, the Al content is set to 0.01% to 0.15%. The lower limit thereof is preferably 0.02% or more, more preferably 0.03% or more, and further more preferably 0.05% or more. The upper limit thereof is preferably 0.10% or less, more preferably 0.08% or less, and further more preferably 0.07% or less.

Ti: 0.01% to 0.50%

Ti is an element which suppresses the deterioration of corrosion resistance caused by the precipitation of Cr carbonitrides, because it combines preferentially with C and N. An effect thereof is obtained when the content of Ti is 0.01% or more. However, the Ti content is more than 0.50%, the amounts of solute C and solute N are excessively reduced, the strength of grain boundaries after deep drawing is insufficient, and cracking is likely to occur in the vicinity of a weld zone. Thus, the Ti content is set to 0.01% to 0.50%. The lower limit thereof is preferably 0.15% or more, more preferably 0.20% or more, and further more preferably 0.25% or more. The upper limit thereof is preferably 0.45% or less, more preferably 0.40% or less, and further more preferably 0.35% or less. In this specification, carbonitrides include carbides and nitrides.

Nb: 0.01% to 0.50%

Nb is an element which suppresses the deterioration of corrosion resistance caused by the precipitation of Cr carbonitrides, because it combines preferentially with C and N. An effect thereof is obtained when the content of Nb is 0.01% or more. However, the Nb content is more than 0.50%, the amounts of solute C and solute N are excessively reduced, the strength of grain boundaries after deep drawing is insufficient, and cracking is likely to occur in the vicinity of a weld zone. Thus, the Nb content is set to 0.01% to 0.50%. The lower limit thereof is preferably 0.05% or more, more preferably 0.10% or more, and further more preferably 0.15% or more. The upper limit thereof is preferably 0.40% or less, more preferably 0.30% or less, and further more preferably 0.25% or less.

V: 0.01% to 0.50%

V is an element suppressing the deterioration of corrosion resistance caused by the precipitation of Cr carbonitrides. An effect thereof is obtained when the content of V is 0.01% or more. However, an excessive content of more than 0.50% deteriorates the workability and is not suitable for deep drawing. Thus, the V content is set to 0.01% to 0.50%. The lower limit thereof is preferably 0.02% or more, more preferably 0.04% or more, and further more preferably 0.06% or more. The upper limit thereof is preferably 0.30% or less, more preferably 0.20% or less, and further more preferably 0.10% or less.

$$0.30\% \leq Ti+Nb+V \leq 0.60\% \quad (1)$$

As described above, all Ti, Nb, and V are elements which improves the corrosion resistance of welds by suppressing the formation of the Cr carbonitrides. In order to suppress the sensitization due to the precipitation of the Cr carbonitrides to allow the welds to have sufficient corrosion resistance, the sum of the Ti content, the Nb content, and the V content needs to be 0.30% or more. The sum thereof is preferably 0.35% or more, more preferably 0.37% or more, and further more preferably 0.40% or more. In addition, the cooling rate of a weld is usually very fast. Therefore, when only one or two of Ti, Nb, and V are contained, the weld passes rapidly through a temperature range where carbonitrides of each element are likely to precipitate; hence, C and N cannot be completely detoxified in some cases. Therefore, the content of each of Ti, Nb, and V needs to be 0.01% or more.

However, when the sum of the Ti content, the Nb content, and the V content is more than 0.60%, the workability deteriorates, which is not suitable for deep drawing. Thus, the sum of the Ti content, the Nb content, and the V content is set to 0.60% or less. The sum thereof is preferably 0.55% or less, more preferably 0.50% or less, and further more preferably 0.45% or less.

Co: 0.01% to 6.00%

Co is an element important according to aspects of the present invention. Containing Co reduces the thermal expansion coefficient of ferritic stainless steels by changing the electronic property thereof. The reduction of the thermal expansion coefficient relieves the expansion and deformation of a weld zone that are caused by the heat of welding. Cracks are caused in the vicinity of the weld zone after deep drawing by the stress induced by the thermal expansion and deformation due to welding in some cases. Since the reduction of the thermal expansion coefficient by containing Co relaxes the stress load applied to the vicinity of the weld zone by the thermal effect and deformation due to welding, the occurrence of cracking is suppressed. An effect thereof is obtained when the content of Co is 0.01% or more. However, when the Co content is more than 6.00%, the workability deteriorates, which is not suitable for deep drawing. Thus, the Co content is set to 0.01% to 6.00%. The lower limit thereof is preferably 0.03% or more, more preferably 0.04% or more, and further more preferably 0.05% or more. The upper limit thereof is preferably 3.00% or less, more preferably 2.50% or less, and further more preferably 2.00% or less.

B: 0.0002% to 0.0050%

B is an element important according to aspects of the present invention. In high-purity ferritic stainless steels subjected to deep drawing, P segregates at grain boundaries in a wall portion of a deep-drawn part and therefore the grain boundaries embrittle. Therefore, cracks are caused in a deep drawing direction in some cases after excessive deep drawing is performed. In particular, this tendency is significant in a component in which the amounts of solid solution C and solid solution N are reduced by Ti or Nb. In grain boundaries likely to undergo cracking due to deep drawing, the stress load due to the thermal effect of welding causes cracks in some cases. Containing B suppresses the segregation of P caused by deep drawing to strengthen grain boundaries and, suppresses the occurrence of such cracks. This effect is obtained by containing 0.0002% or more B. However, when the content of B is more than 0.0050%, the workability deteriorates, which is not suitable for deep drawing. Thus, the B content is set to 0.0002% to 0.0050%. The lower limit thereof is preferably 0.0003% or more, more preferably 0.0004% or more, and further more preferably 0.0006% or more. The upper limit thereof is preferably 0.0020% or less, more preferably 0.0015% or less, and further more preferably 0.0010% or less.

N: 0.001% to 0.020%

N has the effect of improving the strength of steel by solid solution strengthening. The effect is obtained when the content of N is 0.001% or more. However, when the N content is more than 0.020%, the deterioration of workability is significant, which is not suitable for deep drawing. Thus, the N content is set to 0.001% to 0.020%. The lower limit thereof is preferably 0.002% or more, more preferably 0.003% or more, and further more preferably 0.007% or more. The upper limit thereof is preferably 0.018% or less, more preferably 0.015% or less, and further more preferably 0.013% or less.

The ferritic stainless steel according to aspects of the present invention may contain components (optional components) below.

Zr: 1.0% or Less

Zr has the effect of suppressing sensitization by combining with C and N. The effect is obtained by setting the content of Zr to 0.01% or more. The Zr content is preferably 0.03% or more and more preferably 0.06% or more. However, excessively containing Zr deteriorates the workability. Since Zr is a very expensive element, excessively containing Zr causes an increase in cost. Thus, the Zr content is set to 1.0% or less. The Zr content is preferably 0.60% or less and more preferably 0.30% or less.

W: 1.0% or Less

W, as well as Mo, has the effect of improving the corrosion resistance. The effect is obtained by setting the content of W to 0.01% or more. The W content is preferably 0.10% or more and more preferably 0.30% or more. However, excessively containing W increases the strength and deteriorates the manufacturability. Thus, the W content is set to 1.0% or less. The W content is preferably 0.80% or less and more preferably 0.60% or less.

REM: 0.1% or Less

The REM improves the oxidation resistance and suppresses the formation of oxide scales, thereby improving the corrosion resistance of a weld zone. An effect thereof is obtained by setting the content of the REM to 0.001% or more. The REM content is preferably 0.004% or more and more preferably 0.006% or more. However, excessively containing the REM deteriorates manufacturability including pickling properties and causes an increase in cost. Thus, the REM content is set to 0.1% or less. The REM content is preferably 0.04% or less and more preferably 0.02% or less.

The remainder other than the above are Fe and inevitable impurities. The inevitable impurities include Zn: 0.03% or less, Sn: 0.3% or less, Cu: less than 0.1%, and the like. In the case of the ferritic stainless steel which is excellent in corrosion resistance due to having a Cr content and a Mo content in the range of the present invention, Cu increases the passive current to destabilize passive films so that Cu has the harmful influence of deteriorating the corrosion resistance.

From this viewpoint, it is preferable that no Cu is contained. When Cu is contained, the content thereof is appropriately less than 0.1%. Thus, the content of Cu, which is an impurity, is set to less than 0.1%.

A method for manufacturing the ferritic stainless steel according to aspects of the present invention is not particularly limited. A preferable example of the manufacturing method is described below.

After being heated to 1,100° C. to 1,300° C., a stainless steel having the above composition is hot-rolled at a finish temperature of 700° C. to 1,000° C. and a coiling temperature of 400° C. to 800° C. such that the thickness is 2.0 mm to 5.0 mm. A hot-rolled steel strip prepared as described above is annealed at a temperature of 800° C. to 1,100° C. and is then pickled. Next, the steel strip is cold-rolled such that the thickness is 0.5 mm to 2.0 mm. The cold-rolled steel sheet is annealed at a temperature of 700° C. to 1,050° C. The cold-rolled steel sheet is pickled after annealing, whereby scales are removed therefrom. The cold-rolled steel strip free from the scales may be subjected to skin-pass rolling.

In accordance with aspects of the present invention (first embodiment of the invention), the Mo content, the Ti content, the Nb content, the V content, and the Co content are adjusted within a specific range such that Formulas (2) and (3) below are satisfied, whereby the effect of reducing the surface roughening due to working is provided. Aspects of the invention (second embodiment of the invention) having this effect is described below.

First, the problem of surface roughening due to working is described. In the case of forming ferritic stainless steels by working such as pressing, there is a problem in that the surface roughening due to working is serious in some cases.

Ridging and an orange peel are well known as the roughening due to working of ferritic stainless steel sheets.

Ridging is a ridged wrinkle formed by press-forming ferritic stainless steels. This wrinkle deteriorates surface quality of a stainless steel and a crack is caused along this wrinkle by severe working in some cases.

For the ridging, it is said that coarse columnar structures formed in a casting stage form textures with similar orientations without being sufficiently refined by hot rolling or recrystallization, the textures exhibit similar deformation behaviors during press forming, and therefore ridged wrinkles are formed. Thus, reducing the proportion of columnar structures in a cast structure and increasing the proportion of equiaxed structures are important in suppressing the ridging.

As a technique for increasing the number of equiaxed crystals in a cast structure, a ferritic stainless steel with excellent formability and a ferritic stainless steel slab is disclosed in, for example, Japanese Unexamined Patent Application Publication No. 2000-144342. According to aspects of this invention, the amount of solute Al is reduced and Al inclusions are dispersed in molten steel. This allows Ti inclusions to be dispersed or precipitated in molten steel using the Al inclusions as nuclei and allows the Ti inclusions to serve as sites producing equiaxed crystals; hence, the equiaxed crystal ratio in a cast structure increases. However, there is a problem in that it is very operationally difficult that a sufficient amount of Al is added for deoxidation and solute Al is controlled to 0.015% by mass.

An orange peel is surface roughening due to coarse grains and the refinement of grains is an effective measure against surface roughening. As a technique for reducing the orange peel, a ferritic stainless steel sheet with excellent deep drawability is disclosed in, for example, No. 2003-138349. According to aspects of this invention, the composition of steel and conditions for producing the steel are controlled within an appropriate range, the average r-value of a finish-rolled steel sheet is set to 2.0 or more, the average grain size is set to 50 μm or less, and (tensile strength (MPa)×average r-value)/(grain size (μm)) is set to 20 or more, whereby excellent deep drawability and surface roughening resistance are both achieved. However, in accordance with aspects of this invention, there is a problem in that seizing or surface roughening occurs in high-corrosion resistance materials (materials with a high Cr or Mo content) to deteriorate surface properties, because the hot rolling reduction needs to be large for the purpose of refining grains.

Furthermore, as a technique for suppressing surface roughening due to working such as ridging or an orange peel, a ferritic stainless steel sheet and a method for manufacturing the same are disclosed in, for example, Japanese Unexamined Patent Application Publication No. 2002-285300. According to aspects of this invention, cold rolling is performed twice or more including intermediate annealing, whereby a grain size number of 6.0 or more is achieved. However, a method in which cold rolling is performed twice or more has a problem that manufacturing load is high and manufacturing takes a long time.

In the conventional techniques for improving surface roughening due to working as described above, an appropriate method applicable to actual operations has not been obtained at present.

Aspects of the present invention (second embodiment of the invention), in which the Mo content, the Ti content, the Nb content, the V content, and the Co content are adjusted within a specific range such that Formulas (2) and (3) below are satisfied, solves these problems. That is, the second embodiment of the invention provides a ferritic stainless steel which is easily manufactured; which is suitable for structures formed by working including deep drawing, bulging, and bending; which is suitable for applications requiring surface properties after working; and in which the surface roughening due to working is reduced.

Findings obtained in completing the second embodiment of the invention are as described below. The influence of the addition of Co, B, or another element to ferritic stainless steels on the equiaxed crystal ratio in a cast structure and the grain size of final products has been investigated, whereby findings below have been obtained from the relationship between a component and surface roughening due to working, and the corrosion resistance of a worked portion.

(1) Appropriately controlling the content of each of Ti, Nb, and V enables low recrystallization temperature to be achieved without deteriorating the corrosion resistance of a worked portion and allows the control of the grain size to be easy.

(2) Controlling the content of each of Co and B within an appropriate range increases the equiaxed crystal ratio in a cast structure and suppresses the growth of grains due to hot rolling and annealing, resulting in the refinement of the grains.

As a result, in addition to Findings (1) and (2), controlling the content of Mo reduces the surface roughening due to working. The Mo content, the Ti content, the Nb content, the V content, the Co content, Formula (2), and Formula (3) in the second embodiment of the invention are described below. The B content is the same as that in the first embodiment of the invention. As is clear from the fact that B is included in Formula (3), B is important in the second embodiment of the invention. Therefore, B in the second embodiment of the invention is also described below. As is the case with the description of the first embodiment of the invention, "%" refers to "mass percent". Incidentally, components, other than the Mo content, the Ti content, the Nb content, the V content, the Co content, and the B content, including optional components are the same as those in the first embodiment of the invention and therefore are not described in detail. Furthermore, in the second embodiment of the invention, Formula (1) needs to be satisfied. Formula (1) is the same as that in the first embodiment of the invention and therefore is not described in detail.

Mo: 0.30% to 1.50%

The Mo content in the second embodiment of the invention is as described above and is narrower than the Mo content in the first embodiment of the invention. Thus, in the second embodiment of the invention, Mo has the technical significance of Mo in the first embodiment of the invention. The technical significance of Mo in the second embodiment of the invention is as described below. Mo is an element which improves the corrosion resistance of stainless steels by promoting the repassivation of a passive film. When Mo is contained together with Cr, an effect thereof is significant. The effect of improving the corrosion resistance by Mo is obtained when the content thereof is 0.30% or more. However, when the Mo content is more than 1.50%, the strength increases, the workability deteriorates, and surface roughening is likely to occur. Thus, the Mo content is set to 0.30% to 1.50%. The lower limit thereof is preferably 0.40% or more, more preferably 0.50% or more, and further more preferably 0.55% or more. The upper limit thereof is preferably 1.40% or less, more preferably 0.90% or less, and further more preferably 0.70% or less.

Ti: 0.25% to 0.40%

The Ti content in the second embodiment of the invention is as described above and is narrower than the Ti content in the first embodiment of the invention. Thus, in the second embodiment of the invention, Ti has the technical significance of Ti in the first embodiment of the invention. The technical significance of Ti in the second embodiment of the invention is as described below. Ti, as well as Nb and V, is an element which suppresses sensitization because it combines with solid solution C and solid solution N and forms carbonitrides. In addition, Ti is an element which increases the equiaxed crystal ratio in a solidification structure because Ti precipitates from molten steel in the form of TiN, which serves as a precipitation nucleus for equiaxed crystals. The effect of promoting the formation of the equiaxed crystals is obtained when Ti is 0.25% or more. However, when the Ti content is more than 0.40%, the embrittlement of a worked portion is promoted, cracking is likely to be caused by working, and the workability deteriorates. Thus, the content of Ti is set to 0.25% to 0.40%. The lower limit thereof is preferably 0.27% or more, more preferably 0.29% or more, and further more preferably 0.31% or more. The upper limit thereof is preferably 0.38% or less, more preferably 0.35% or less, and further more preferably 0.34% or less.

Nb: 0.03% to 0.13%

V: 0.02% to 0.13%

$$Nb+V \leq 0.22\% \quad \text{Formula (3)}$$

The Nb and V content in the second embodiment of the invention is as described above and is narrower than the Nb and V content in the first embodiment of the invention. Thus, in the second embodiment of the invention, Nb and V have the technical significance of Nb and V in the first embodiment of the invention. The technical significance of Nb and V in the second embodiment of the invention is as described below. Both Nb and V are elements which form carbonitrides by combining with solid solution C and solid solution N. Since the sensitization of a weld is suppressed by fixing solid solution C and solid solution N, the corrosion resistance is improved. In particular, when all Ti, Nb, and V are contained, C and N can be more appropriately detoxified because of the difference in precipitation temperature therebetween. In order to obtain an effect thereof, the Nb content needs to be 0.03% or more. However, when the Nb content is more than 0.13%, recrystallization is suppressed, higher annealing temperature is necessary to obtain an appropriate structure, the formation of a fine microstructure is difficult, and surface roughening is likely to occur during working. Thus, the Nb content is set to 0.03% to 0.13%. The lower limit thereof is preferably 0.06% or more, more preferably 0.07% or more, and further more preferably 0.08% or more. The upper limit thereof is preferably 0.11% or less, more preferably 0.10% or less, and further more preferably 0.09% or less.

In order to obtain the above effect, the V content needs to be 0.02% or more. However, when the V content is excessive, more than 0.13%, the recrystallization temperature increases, the formation of a fine microstructure is difficult, and surface roughening is likely to occur during working. Thus, the V content is set to 0.02% to 0.13%. The lower limit thereof is preferably 0.04% or more, more preferably 0.06% or more, and further more preferably 0.07% or more. The upper limit thereof is preferably 0.11% or less, more preferably 0.10% or less, and further more preferably 0.08% or less.

On the other hand, carbonitrides of Nb. and V increase the recrystallization temperature of stainless steels and therefore high temperature is necessary for annealing. Therefore, when the sum of the contents of these elements is more than 0.22%, it is difficult to prepare an appropriate structure by controlling the annealing temperature and surface roughening due to working such as an orange peel is likely to occur. Thus, Nb+V is set to 0.22% or less. Nb+V is preferably 0.20% or less, more preferably 0.18% or less, and further more preferably 0.16% or less. The lower limit of Nb+V is not particularly limited, is preferably 0.08% or more, and is more preferably 0.10% or more. Incidentally, the symbol of each element in "Nb+V" of Formula (3) represents the content (mass percent) of the element.

B: 0.0002% to 0.0050%

Co: 0.02% to 0.30%

$$Co/B: 10 \text{ to } 150 \quad \text{Formula (2)}$$

The Co content in the second embodiment of the invention is as described above and is narrower than the Co content in the first embodiment of the invention. The B content is the same as the range of the first embodiment of the invention. Thus, in the second embodiment of the invention, Co and B have the technical significance of Co and B in the first embodiment of the invention. The technical significance of Co and B in the second embodiment of the invention is as described below. The gist of a technique of reducing surface roughening due to working is that $(Cr, Fe)_2B$ is precipitated at grain boundaries in an appropriately dispersed in a solidification stage of a casting process and therefore the equiaxed crystal ratio is increased; hence, B is an element important in accordance with aspects of the present invention. It is supposed that dispersively precipitated $(Cr, Fe)_2B$ has the effect of suppressing the growth of grains during hot rolling and annealing. As described above, the development of textures is suppressed and the growth of grains is suppressed, whereby surface roughening due to working is reduced in accordance with aspects of the present invention. This effect is obtained when the B content is 0.0002% or more. However, when the B content is more than 0.0050%, the workability is deteriorated and cracking is likely to occur. Thus, the B content is set to 0.0002% to 0.0050%. The lower limit thereof is preferably 0.0003% or more, more preferably 0.0004% or more, and further more preferably 0.0006% or more. The upper limit thereof is preferably 0.0020% or less, more preferably 0.0018% or less, and further more preferably 0.0015% or less.

In the precipitation of $(Cr, Fe)_2B$ in the casting stage, Co probably has the effect of maintaining $(Cr, Fe)_2B$ in an appropriate dispersion state by suppressing the aggregation of $(Cr, Fe)_2B$. As a result, the growth of columnar structures is suppressed and therefore the surface roughening due to working is reduced. Thus, Co is an element important in accordance with aspects of the present invention. This effect is obtained when the Co content is 0.02% or more. However, when the Co content is more than 0.30%, the workability deteriorates and cracking is likely to occur. Thus, the Co content is set to 0.02% to 0.30%. The lower limit thereof is preferably 0.03% or more, more preferably 0.04% or more, and further more preferably 0.05% or more. The upper limit thereof is preferably 0.20% or less, more preferably 0.10% or less, and further more preferably 0.08% or less.

Furthermore, in accordance with aspects of the present invention, in order to obtain an appropriate equiaxed crystal ratio, the content ratio of Co to B needs to be set to an appropriate range. Although a detailed mechanism has not been clear yet, it is supposed that, when the content of B is excessively higher than the content of Co, Co cannot sufficiently suppress the aggregation of $(Cr, Fe)_2B$. Thus, Co/B is appropriately 10 or more. However, when the Co content is too high, it is supposed that the precipitation temperature of $(Cr, Fe)_2B$ decreases and the growth of columnar crystals cannot be suppressed at an appropriate temperature. Thus, Co/B is appropriately 150 or less. Hence, Co/B is set to 10 to 150. The lower limit thereof is preferably 20 or more, more preferably 30 or more, and further more preferably 40 or more. The upper limit thereof is preferably 120 or less, more preferably 100 or less, and further more preferably 80 or less.

Finally, a preferable example of a method for, manufacturing the stainless steel according to the second embodiment of the invention is described below.

After molten steel is adjusted in a converter so as to have the above composition, a slab with a thickness of 100 mm to 300 mm is prepared at a molten steel superheat $\Delta T$ of 20° C. to 80° C. and a casting rate of 0.4 m/min to 1.1 m/min. After being heated to 1,100° C. to 1,300° C., the obtained slab is hot-rolled to a thickness of 2.0 mm to 5.0 mm at a finish temperature of 600° C. to 900° C. and a coiling temperature of 400° C. to 800° C. The final rolling reduction is set to 15% or more. For the refinement of grains during hot rolling and annealing for rolling, the finish temperature is preferably 600° C. to 750° C. and the final rolling reduction is preferably 40% or more. In order to suppress embrittlement at 475° C. to obtain good manufacturability, the coiling temperature is preferably 400° C. to 450° C. A hot-rolled steel strip prepared as described above is annealed at a temperature of 800° C. to 980° C. The soaking time in annealing is appropriately 10 s to 300 s. For the refinement of grains, the annealing temperature is preferably low in a temperature range where recrystallization is possible and is preferably 800° C. to 900° C. The annealing time is preferably short and is preferably 10 s to 180 s. Thereafter, pickling is performed, followed by cold rolling, whereby a cold-rolled steel strip with a thickness of 0.3 mm to 3.0 mm is prepared. The obtained cold-rolled steel strip is cold-rolled and annealed at a temperature of 700° C. to 1,050° C. After cold rolling and annealing, pickling is performed, whereby scales are removed. At an intermediate between these manufacturing processes and the last, descaling by mechanical action such as skin-pass rolling or shot blasting or grinding/polishing with a grinder or a polishing belt may be performed.

Example 1

Aspects of the present invention are described below with reference to an example.

Each of stainless steels shown in Table 1 was cast into a 100 kg steel ingot in a vacuum. After being heated to 1,200° C. the steel ingot was hot-rolled to a thickness of 4 mm, followed by annealing within the range of 800° C. to 1,000° C. and removing scales by pickling. Furthermore, cold rolling to a thickness of 0.8 mm was performed, annealing was performed within the range of 800° C. to 950° C., and pickling was performed, whereby a sample was prepared.

A 72 mm diameter disk was taken from the prepared sample, and was formed by cylindrical deep drawing in four stages sequentially using a 49 mm diameter punch, a 35 mm diameter punch, a 26 mm diameter punch, and a 22 mm diameter punch (each having a shoulder radius of 2 mm) and an ear was trimmed such that the height after working was 50 mm (FIG. 1(*a*).). Furthermore, a 5 mm diameter hole was drilled in a central portion of the cup bottom, whereby a cylindrical deep drawing-shaped specimen was prepared. Thereafter, a 23 mm diameter disk was joined to the specimen by TIG welding such that a 22 mm diameter opening of the specimen was blocked (FIG. 1(*b*)). Welding conditions were set to a welding current of 100 A and a welding speed of 60 cm/min. A shielding gas used was Ar and the flow rate thereof was set to 20 L/min. After a lapse of 24 h from welding, an inner portion of the specimen was filled with water by pouring water from the 5 mm diameter hole and a pressure of 10 atmospheres was applied to the specimen, whereby the presence or absence of cracks was confirmed. Thereafter, the vicinity of a weld (a position 2-5 mm away from a fusion line) of a cylindrical deep drawing wall was observed at 200× magnification using an optical microscope (the observation of a crack-observing position in FIG. 1(*b*)), whereby the length of a crack was identified. Those having a crack with a length of 0.5 mm or more were rated "x" (unacceptable) and those having no crack were rated "○" (acceptable). The results are shown in Table 2. Incidentally, in every specimen, no cracks were found in a fusion line.

Referring to Table 2, in all inventive examples, no cracks could be found in the vicinity of a weld zone. However, in No. 12, which was a comparative example, no Co was contained and therefore cracking occurred. In No. 13, no B was contained and therefore cracking occurred. In No. 14, Al was excessively added and therefore cracking occurred. In No. 15, Cr was excessively added and therefore cracking occurred.

Subsequently, the corrosion resistance of an as-welded weld zone was evaluated using each specimen used to confirm the presence or absence of cracks. A cyclic neutral salt spray corrosion test was performed in accordance with JIS H 8502 for five cycles and the presence or absence of corrosion in the vicinity of the weld zone (an area from a fusion line to a line which is 5 mm away from the center of a weld bead) was visually confirmed. The specimen was placed in a corrosion test chamber such that the 5 mm diameter hole faced downward. Those in which corrosion with a longitudinal size of 1 mm or more was caused in the vicinity of a weld zone by the test performed for five cycles were rated "x" (unacceptable) and those in which corrosion was not caused were rated "○" (acceptable) as shown in Table 2.

All Nos. 12, 13, and 14 underwent corrosion arising from cracks in the vicinity of a weld zone. No. 16 did not satisfy Formula (1) and therefore corrosion was caused from a weld bead. No. 17 had a low Cr content and therefore corrosion was caused from a weld bead and a tempered portion. No. 18 contained no Nb and therefore corrosion was caused from a weld bead. No. 19 contained no Ti and therefore corrosion was caused from a weld bead. No. 20 contained no V and therefore corrosion was caused from a weld bead.

TABLE 1

| No | C | Si | Mn | P | S | Cr | Ni | Mo | Al | V |
|---|---|---|---|---|---|---|---|---|---|---|
| 1 | 0.012 | 0.13 | 0.15 | 0.03 | 0.002 | 21.0 | 0.11 | 1.52 | 0.04 | 0.04 |
| 2 | 0.014 | 0.18 | 0.16 | 0.02 | 0.002 | 18.7 | 0.04 | 0.51 | 0.07 | 0.05 |
| 3 | 0.009 | 0.19 | 0.10 | 0.02 | 0.001 | 18.5 | 0.03 | 1.09 | 0.14 | 0.09 |
| 4 | 0.007 | 0.22 | 0.12 | 0.03 | 0.001 | 19.1 | 0.09 | 0.35 | 0.05 | 0.07 |
| 5 | 0.010 | 0.09 | 0.13 | 0.03 | 0.001 | 20.4 | 0.13 | 2.03 | 0.06 | 0.08 |
| 6 | 0.011 | 0.10 | 0.08 | 0.03 | 0.001 | 19.7 | 0.15 | 1.61 | 0.08 | 0.06 |
| 7 | 0.008 | 0.11 | 0.09 | 0.03 | 0.002 | 18.8 | 0.19 | 0.71 | 0.03 | 0.03 |
| 8 | 0.016 | 0.14 | 0.11 | 0.03 | 0.002 | 18.3 | 0.13 | 0.64 | 0.02 | 0.18 |
| 9 | 0.015 | 0.15 | 0.26 | 0.02 | 0.002 | 21.6 | 0.11 | 0.44 | 0.09 | 0.25 |
| 10 | 0.013 | 0.16 | 0.42 | 0.03 | 0.002 | 20.9 | 0.12 | 1.27 | 0.10 | 0.12 |
| 11 | 0.019 | 0.20 | 0.31 | 0.03 | 0.002 | 20.1 | 0.10 | 0.95 | 0.11 | 0.10 |
| 12 | 0.012 | 0.14 | 0.17 | 0.03 | 0.001 | 19.8 | 0.15 | 1.02 | 0.07 | 0.05 |
| 13 | 0.010 | 0.11 | 0.18 | 0.02 | 0.002 | 20.3 | 0.09 | 1.15 | 0.08 | 0.02 |
| 14 | 0.015 | 0.16 | 0.14 | 0.02 | 0.001 | 18.6 | 0.07 | 0.89 | 0.23 | 0.04 |
| 15 | 0.009 | 0.13 | 0.10 | 0.02 | 0.001 | 24.5 | 0.14 | 1.36 | 0.10 | 0.09 |
| 16 | 0.017 | 0.17 | 0.13 | 0.02 | 0.001 | 18.9 | 0.10 | 0.82 | 0.05 | 0.06 |

TABLE 1-continued

| | | | | | | | | | | |
|---|---|---|---|---|---|---|---|---|---|---|
| 17 | 0.010 | 0.14 | 0.19 | 0.02 | 0.001 | 17.2 | 0.08 | 0.47 | 0.12 | 0.08 |
| 18 | 0.009 | 0.12 | 0.15 | 0.02 | 0.001 | 19.9 | 0.07 | 0.55 | 0.10 | 0.15 |
| 19 | 0.012 | 0.11 | 0.14 | 0.03 | 0.001 | 20.2 | 0.09 | 0.63 | 0.09 | 0.12 |
| 20 | 0.015 | 0.12 | 0.16 | 0.03 | 0.001 | 21.4 | 0.06 | 0.74 | 0.11 | — |
| 21 | 0.010 | 0.11 | 0.15 | 0.03 | 0.001 | 20.8 | 0.10 | 0.54 | 0.03 | 0.06 |
| 22 | 0.011 | 0.12 | 0.16 | 0.03 | 0.001 | 21.0 | 0.22 | 0.52 | 0.04 | 0.05 |
| 23 | 0.010 | 0.11 | 0.16 | 0.02 | 0.002 | 21.4 | 0.15 | 0.60 | 0.04 | 0.07 |
| 24 | 0.013 | 0.11 | 0.12 | 0.02 | 0.001 | 20.7 | 0.17 | 0.57 | 0.06 | 0.10 |
| 25 | 0.005 | 0.12 | 0.14 | 0.03 | 0.001 | 23.0 | 0.13 | 1.07 | 0.10 | 0.08 |
| 26 | 0.011 | 0.10 | 0.13 | 0.02 | 0.002 | 23.8 | 0.06 | 1.02 | 0.02 | 0.05 |
| 27 | 0.012 | 0.10 | 0.14 | 0.03 | 0.002 | 22.1 | 0.08 | 0.83 | 0.05 | 0.05 |
| 28 | 0.011 | 0.14 | 0.15 | 0.02 | 0.001 | 20.9 | 0.09 | 1.46 | 0.04 | 0.07 |
| 29 | 0.010 | 0.13 | 0.16 | 0.03 | 0.002 | 21.0 | 0.11 | 0.51 | 0.05 | 0.06 |
| 30 | 0.012 | 0.11 | 0.12 | 0.03 | 0.001 | 20.5 | 0.12 | 0.50 | 0.03 | 0.09 |
| 31 | 0.009 | 0.11 | 0.11 | 0.02 | 0.001 | 21.1 | 0.14 | 0.55 | 0.02 | 0.12 |
| 32 | 0.010 | 0.13 | 0.13 | 0.02 | 0.001 | 20.6 | 0.10 | 0.59 | 0.04 | 0.03 |
| 33 | 0.011 | 0.12 | 0.12 | 0.02 | 0.001 | 21.5 | 0.12 | 0.58 | 0.06 | 0.04 |

| No | Ti | Nb | Co | B | N | Formula (1) | Mass percent Another element | Remarks |
|---|---|---|---|---|---|---|---|---|
| 1 | 0.32 | 0.14 | 0.011 | 0.0011 | 0.013 | 0.50 | | Inventive example |
| 2 | 0.16 | 0.19 | 0.032 | 0.0009 | 0.010 | 0.40 | | Inventive example |
| 3 | 0.18 | 0.20 | 0.684 | 0.0008 | 0.011 | 0.47 | | Inventive example |
| 4 | 0.23 | 0.10 | 2.561 | 0.0005 | 0.009 | 0.40 | | Inventive example |
| 5 | 0.19 | 0.11 | 5.327 | 0.0012 | 0.008 | 0.38 | | Inventive example |
| 6 | 0.35 | 0.09 | 0.010 | 0.0046 | 0.006 | 0.50 | | Inventive example |
| 7 | 0.20 | 0.15 | 0.292 | 0.0004 | 0.019 | 0.38 | | Inventive example |
| 8 | 0.19 | 0.16 | 0.026 | 0.0010 | 0.017 | 0.53 | | Inventive example |
| 9 | 0.20 | 0.14 | 0.059 | 0.0023 | 0.015 | 0.59 | Zr:0.21 | Inventive example |
| 10 | 0.11 | 0.35 | 0.094 | 0.0024 | 0.017 | 0.58 | W:0.53 | Inventive example |
| 11 | 0.15 | 0.18 | 0.186 | 0.0019 | 0.012 | 0.43 | REM:0.010 | Inventive example |
| 12 | 0.22 | 0.15 | — | 0.0007 | 0.016 | 0.42 | | Comparative example |
| 13 | 0.29 | 0.16 | 0.046 | — | 0.019 | 0.47 | | Comparative example |
| 14 | 0.30 | 0.18 | 0.028 | 0.0014 | 0.018 | 0.52 | | Comparative example |
| 15 | 0.18 | 0.23 | 0.149 | 0.0016 | 0.014 | 0.50 | | Comparative example |
| 16 | 0.15 | 0.03 | 0.051 | 0.0010 | 0.019 | 0.24 | | Comparative example |
| 17 | 0.19 | 0.16 | 0.106 | 0.0015 | 0.012 | 0.43 | | Comparative example |
| 18 | 0.16 | — | 0.097 | 0.0009 | 0.011 | 0.31 | | Comparative example |
| 19 | — | 0.18 | 0.008 | 0.0006 | 0.016 | 0.30 | | Comparative example |
| 20 | 0.15 | 0.15 | 0.014 | 0.0010 | 0.018 | 0.30 | | Comparative example |
| 21 | 0.27 | 0.05 | 0.049 | 0.0005 | 0.012 | 0.32 | | Inventive example |
| 22 | 0.32 | 0.07 | 0.073 | 0.0004 | 0.014 | 0.39 | Zr:0.13 | Inventive example |
| 23 | 0.28 | 0.08 | 0.081 | 0.0004 | 0.015 | 0.36 | W:0.46 | Inventive example |
| 24 | 0.30 | 0.09 | 0.117 | 0.0006 | 0.012 | 0.39 | REM:0.008 | Inventive example |
| 25 | 0.31 | 0.08 | 0.089 | 0.0008 | 0.013 | 0.39 | | Inventive example |
| 26 | 0.29 | 0.07 | 0.064 | 0.0005 | 0.014 | 0.36 | | Inventive example |
| 27 | 0.33 | 0.10 | 0.028 | 0.0002 | 0.016 | 0.43 | | Inventive example |
| 28 | 0.34 | 0.08 | 0.033 | 0.0004 | 0.015 | 0.42 | | Inventive example |
| 29 | 0.26 | 0.12 | 0.024 | 0.0010 | 0.012 | 0.38 | | Inventive example |
| 30 | 0.37 | 0.06 | 0.052 | 0.0007 | 0.009 | 0.43 | | Inventive example |
| 31 | 0.28 | 0.07 | 0.043 | 0.0006 | 0.013 | 0.35 | | Inventive example |
| 32 | 0.27 | 0.13 | 0.026 | 0.0005 | 0.014 | 0.40 | | Inventive example |
| 33 | 0.29 | 0.09 | 0.284 | 0.0009 | 0.011 | 0.38 | | Inventive example |

Underlined values are outside the scope of the present invention.
Formula (1): Ti + Nb + V

TABLE 2

| No | Presence or absence of cracks in vicinity of weld zone | Presence or absence of corrosion in vicinity of weld zone | Remarks |
|---|---|---|---|
| 1 | ○ | ○ | Inventive example |
| 2 | ○ | ○ | Inventive example |
| 3 | ○ | ○ | Inventive example |
| 4 | ○ | ○ | Inventive example |
| 5 | ○ | ○ | Inventive example |
| 6 | ○ | ○ | Inventive example |
| 7 | ○ | ○ | Inventive example |
| 8 | ○ | ○ | Inventive example |
| 9 | ○ | ○ | Inventive example |
| 10 | ○ | ○ | Inventive example |
| 11 | ○ | ○ | Inventive example |
| 12 | × | × | Comparative example |

TABLE 2-continued

| No | Presence or absence of cracks in vicinity of weld zone | Presence or absence of corrosion in vicinity of weld zone | Remarks |
|---|---|---|---|
| 13 | × | × | Comparative example |
| 14 | × | × | Comparative example |
| 15 | × | ○ | Comparative example |
| 16 | ○ | × | Comparative example |
| 17 | ○ | × | Comparative example |
| 18 | ○ | × | Comparative example |
| 19 | ○ | × | Comparative example |
| 20 | ○ | × | Comparative example |
| 21 | ○ | ○ | Inventive example |
| 22 | ○ | ○ | Inventive example |
| 23 | ○ | ○ | Inventive example |
| 24 | ○ | ○ | Inventive example |

TABLE 2-continued

| No | Presence or absence of cracks in vicinity of weld zone | Presence or absence of corrosion in vicinity of weld zone | Remarks |
|---|---|---|---|
| 25 | ○ | ○ | Inventive example |
| 26 | ○ | ○ | Inventive example |
| 27 | ○ | ○ | Inventive example |
| 28 | ○ | ○ | Inventive example |
| 29 | ○ | ○ | Inventive example |
| 30 | ○ | ○ | Inventive example |
| 31 | ○ | ○ | Inventive example |
| 32 | ○ | ○ | Inventive example |
| 33 | ○ | ○ | Inventive example |

Example 2

Aspects of the present invention are described below with reference to an example.

Each of stainless steels containing components shown in Table 3 was continuously cast under conditions including a molten steel superheat of 60° C. and a casting rate of 0.6 m/min, whereby a slab with a thickness of 200 mm was prepared. After being heated to 1,200° C., the prepared slab was hot-rolled to a thickness of 4 mm under conditions including a finish temperature of 700° C., a coiling temperature of 400° C., and a final rolling reduction of 30% and was annealed at 950° C. such that the soaking time was 60 s. Thereafter, cold rolling to a thickness of 0.8 mm was performed, annealing was performed at 900° C. such that the soaking time was 30 s, and surface scales were removed by polishing, followed by finishing with emery paper #600, whereby a sample was prepared.

A 72 mm diameter disk was taken from the prepared sample and was formed by cylindrical deep drawing in four stages sequentially using a 49 mm diameter punch, a 35 mm diameter punch, a 26 mm diameter punch, and a 22 mm diameter punch (each having a shoulder radius of 2 mm) and an ear was trimmed such that the height after working was 50 mm (FIG. 1(*a*)). For a prepared specimen, four sites were selected such that each measuring position, located 10 mm away from an opening, having a length of 5 mm in the circumferential direction was located at 90° on the circumference, followed by measuring surface irregularities using a laser microscope (measurement at irregularity-measuring positions in FIG. 1(*a*)). Obtained results were assumed to be irregularities on an arc with a diameter of 22 mm and were corrected so as to be irregularities on a plane, the difference between the maximum peak height and the maximum valley depth was measured, and results of the measured four sites were averaged. Among the stainless steels in Table 3, those in which the difference between the maximum peak height and the maximum valley depth was 200 μm or more were rated "Δ" (significant irregularities equivalent to conventional techniques) and those in which the difference therebetween was 200 μm or less were rated "⊙" (free from significant irregularities and excellent). The results are shown in Table 4.

Referring to Table 3, in Nos. 34 to 46, in which all of Mo, Ti, Nb, V, Co, Formula (2), and Formula (3) were inside the scope of claim 2, no significant irregularities were observed on a wall after deep drawing. However, in Nos. 47 to 61, any one of Mo, Ti, Nb, V, Co, Formula (2), and Formula (3) was outside the scope of claim 2 and therefore significant irregularities were observed on a wall after deep drawing. In No. 62, B was outside the scope of claim 1 and therefore significant irregularities were observed on a wall of a specimen.

Next, a 5 mm diameter hole was formed in a central portion of the cup bottom, whereby a cylindrical deep drawing-shaped specimen was prepared. Thereafter, a 23 mm diameter disk was joined to the specimen by TIG welding such that a 22 mm diameter opening of the specimen was blocked (FIG. 1(*b*)). Welding conditions were set to a welding current of 100 A and a welding speed of 60 cm/min. A shielding gas used was Ar and the flow rate thereof was set to 20 L/min. After a lapse of 24 h from welding, an inner portion of the specimen was filled with water by pouring water from the 5 mm diameter hole and a pressure of 10 atmospheres was applied to the specimen, whereby the presence or absence of cracks was confirmed. Thereafter, the vicinity of a weld zone (a position 2-5 mm away from a fusion line) of a cylindrical deep drawing wall was observed at 200× magnification using an optical microscope (the observation of a crack-observing position in FIG. 1(*b*)), whereby the length of a crack was identified. Those having a crack with a length of 0.5 mm or more were rated "x" (unacceptable) and those having no crack were rated "○" (acceptable). The results are shown in Table 4.

Referring to Table 3, in all inventive examples, no crack could be confirmed in the vicinity of a weld zone. However, in No. 62, which was a comparative example, cracks occurred in the vicinity of a weld zone.

Subsequently, the corrosion resistance of an as-welded weld zone was evaluated using each specimen used to confirm the presence or absence of cracks. A cyclic neutral salt spray corrosion test was performed in accordance with JIS H 8502 for five cycles and the presence or absence of corrosion in the vicinity of the weld zone (an area from a fusion line to a line which is 5 mm away from the center of a weld bead) was visually confirmed. The specimen was placed in a corrosion test chamber such that the 5 mm diameter hole faced downward. Those in which corrosion with a longitudinal size of 1 mm or more was caused in the vicinity of a weld zone by the test performed for five cycles were rated "x" (unacceptable) and those in which corrosion was not caused were rated "○" (acceptable) as shown in Table 4. Referring to Table 4, in all inventive examples, corrosion could not be confirmed in the vicinity of a weld zone. However, in No. 62, which was a comparative example, corrosion occurred in the vicinity of a weld zone.

From the above results, it was confirmed that, according to aspects of the present invention, a ferritic stainless steel, having little surface roughening due to working, excellent in weld shape and corrosion resistance was obtained.

TABLE 3

| No | C | Si | Mn | P | S | Cr | Ni | Mo | Al | V | Ti |
|---|---|---|---|---|---|---|---|---|---|---|---|
| 34 | 0.008 | 0.13 | 0.15 | 0.02 | 0.002 | 21.0 | 0.20 | 0.53 | 0.03 | 0.04 | 0.30 |
| 35 | 0.010 | 0.11 | 0.16 | 0.02 | 0.003 | 20.9 | 0.14 | 1.47 | 0.04 | 0.07 | 0.31 |
| 36 | 0.009 | 0.12 | 0.18 | 0.02 | 0.002 | 20.8 | 0.13 | 0.49 | 0.03 | 0.08 | 0.25 |

TABLE 3-continued

| | | | | | | | | | | | |
|---|---|---|---|---|---|---|---|---|---|---|---|
| 37 | 0.011 | 0.11 | 0.15 | 0.01 | 0.001 | 20.5 | 0.10 | 0.62 | 0.05 | 0.05 | 0.38 |
| 38 | 0.011 | 0.13 | 0.14 | 0.02 | 0.001 | 20.4 | 0.22 | 0.52 | 0.03 | 0.11 | 0.32 |
| 39 | 0.010 | 0.10 | 0.13 | 0.03 | 0.001 | 20.6 | 0.18 | 0.38 | 0.03 | 0.10 | 0.33 |
| 40 | 0.009 | 0.14 | 0.12 | 0.02 | 0.002 | 20.7 | 0.14 | 0.45 | 0.05 | 0.07 | 0.32 |
| 41 | 0.011 | 0.12 | 0.15 | 0.03 | 0.002 | 20.8 | 0.16 | 0.50 | 0.04 | 0.09 | 0.31 |
| 42 | 0.012 | 0.12 | 0.16 | 0.02 | 0.001 | 21.4 | 0.15 | 0.51 | 0.06 | 0.07 | 0.30 |
| 43 | 0.013 | 0.13 | 0.14 | 0.02 | 0.002 | 21.5 | 0.15 | 0.58 | 0.05 | 0.08 | 0.30 |
| 44 | 0.006 | 0.10 | 0.15 | 0.02 | 0.001 | 22.8 | 0.13 | 1.07 | 0.14 | 0.07 | 0.33 |
| 45 | 0.015 | 0.11 | 0.13 | 0.03 | 0.003 | 21.3 | 0.12 | 0.56 | 0.06 | 0.05 | 0.34 |
| 46 | 0.011 | 0.13 | 0.12 | 0.02 | 0.002 | 21.2 | 0.11 | 0.52 | 0.07 | 0.07 | 0.32 |
| 47 | 0.012 | 0.10 | 0.15 | 0.02 | 0.002 | 21.3 | 0.13 | 1.55 | 0.09 | 0.07 | 0.32 |
| 48 | 0.010 | 0.09 | 0.16 | 0.03 | 0.003 | 21.0 | 0.12 | 0.57 | 0.03 | 0.08 | 0.22 |
| 49 | 0.013 | 0.10 | 0.14 | 0.01 | 0.002 | 21.1 | 0.17 | 0.53 | 0.02 | 0.08 | 0.43 |
| 50 | 0.009 | 0.13 | 0.12 | 0.03 | 0.002 | 21.1 | 0.15 | 0.61 | 0.05 | 0.01 | 0.31 |
| 51 | 0.010 | 0.10 | 0.10 | 0.02 | 0.002 | 20.9 | 0.15 | 0.51 | 0.04 | 0.14 | 0.32 |
| 52 | 0.011 | 0.13 | 0.10 | 0.02 | 0.002 | 21.0 | 0.14 | 0.52 | 0.03 | 0.07 | 0.33 |
| 53 | 0.013 | 0.12 | 0.13 | 0.02 | 0.002 | 20.5 | 0.13 | 0.53 | 0.06 | 0.05 | 0.32 |
| 54 | 0.012 | 0.15 | 0.12 | 0.02 | 0.001 | 20.9 | 0.12 | 0.51 | 0.03 | 0.08 | 0.31 |
| 55 | 0.015 | 0.16 | 0.15 | 0.02 | 0.002 | 20.8 | 0.16 | 0.50 | 0.04 | 0.08 | 0.32 |
| 56 | 0.011 | 0.14 | 0.14 | 0.02 | 0.003 | 20.6 | 0.14 | 0.56 | 0.06 | 0.07 | 0.33 |
| 57 | 0.011 | 0.10 | 0.13 | 0.03 | 0.002 | 21.4 | 0.15 | 0.55 | 0.05 | 0.07 | 0.34 |
| 58 | 0.012 | 0.12 | 0.12 | 0.02 | 0.002 | 21.3 | 0.17 | 0.54 | 0.05 | 0.11 | 0.31 |
| 59 | 0.003 | 0.11 | 0.15 | 0.03 | 0.002 | 22.5 | 0.14 | 0.97 | 0.11 | 0.09 | 0.30 |
| 60 | 0.005 | 0.10 | 0.14 | 0.02 | 0.003 | 22.9 | 0.12 | 1.16 | 0.08 | 0.07 | 0.32 |
| 61 | 0.004 | 0.13 | 0.12 | 0.02 | 0.002 | 23.0 | 0.13 | 1.04 | 0.09 | 0.13 | 0.32 |
| 62 | 0.009 | 0.12 | 0.13 | 0.03 | 0.002 | 21.2 | 0.15 | 0.59 | 0.05 | 0.07 | 0.33 |

| No | Nb | Co | B | N | Formula (1) | Formula (2) | Formula (3) | Mass percent Another element | Remarks |
|---|---|---|---|---|---|---|---|---|---|
| 34 | 0.07 | 0.052 | 0.0005 | 0.012 | 0.37 | 104 | 0.11 | | Inventive example |
| 35 | 0.08 | 0.046 | 0.0006 | 0.014 | 0.39 | 77 | 0.15 | | Inventive example |
| 36 | 0.10 | 0.030 | 0.0005 | 0.010 | 0.35 | 60 | 0.18 | | Inventive example |
| 37 | 0.09 | 0.034 | 0.0007 | 0.010 | 0.47 | 49 | 0.14 | | Inventive example |
| 38 | 0.09 | 0.029 | 0.0010 | 0.011 | 0.41 | 29 | 0.20 | | Inventive example |
| 39 | 0.12 | 0.038 | 0.0014 | 0.013 | 0.45 | 27 | 0.22 | | Inventive example |
| 40 | 0.11 | 0.292 | 0.0045 | 0.015 | 0.43 | 65 | 0.18 | | Inventive example |
| 41 | 0.09 | 0.025 | 0.0021 | 0.014 | 0.40 | 12 | 0.18 | | Inventive example |
| 42 | 0.10 | 0.068 | 0.0005 | 0.012 | 0.40 | 136 | 0.17 | | Inventive example |
| 43 | 0.08 | 0.051 | 0.0008 | 0.010 | 0.38 | 64 | 0.16 | | Inventive example |
| 44 | 0.07 | 0.047 | 0.0012 | 0.012 | 0.40 | 39 | 0.14 | Zr:0.11 | Inventive example |
| 45 | 0.08 | 0.046 | 0.0016 | 0.013 | 0.42 | 29 | 0.13 | W:0.42 | Inventive example |
| 46 | 0.08 | 0.082 | 0.0009 | 0.011 | 0.40 | 91 | 0.15 | REM:0.007 | Inventive example |
| 47 | 0.09 | 0.070 | 0.0010 | 0.011 | 0.41 | 70 | 0.16 | | Inventive example |
| 48 | 0.09 | 0.043 | 0.0005 | 0.013 | 0.31 | 86 | 0.17 | | Inventive example |
| 49 | 0.10 | 0.045 | 0.0010 | 0.015 | 0.53 | 45 | 0.18 | | Inventive example |
| 50 | 0.10 | 0.038 | 0.0008 | 0.014 | 0.41 | 48 | 0.11 | | Inventive example |
| 51 | 0.07 | 0.039 | 0.0012 | 0.010 | 0.39 | 33 | 0.21 | | Inventive example |
| 52 | 0.02 | 0.040 | 0.0005 | 0.015 | 0.35 | 80 | 0.09 | | Inventive example |
| 53 | 0.15 | 0.026 | 0.0005 | 0.012 | 0.47 | 52 | 0.20 | | Inventive example |
| 54 | 0.05 | 0.013 | 0.0006 | 0.011 | 0.36 | 22 | 0.13 | | Inventive example |
| 55 | 0.07 | 0.332 | 0.0045 | 0.012 | 0.39 | 74 | 0.15 | | Inventive example |
| 56 | 0.06 | 0.027 | 0.0035 | 0.012 | 0.39 | 8 | 0.13 | | Inventive example |
| 57 | 0.08 | 0.056 | 0.0003 | 0.012 | 0.42 | 187 | 0.15 | | Inventive example |
| 58 | 0.12 | 0.037 | 0.0005 | 0.013 | 0.43 | 74 | 0.23 | | Inventive example |
| 59 | 0.04 | 0.028 | 0.0042 | 0.012 | 0.34 | 7 | 0.13 | | Inventive example |
| 60 | 0.07 | 0.121 | 0.0007 | 0.011 | 0.39 | 173 | 0.14 | | Inventive example |
| 61 | 0.11 | 0.030 | 0.0007 | 0.013 | 0.43 | 43 | 0.24 | | Inventive example |
| 62 | 0.08 | 0.031 | — | 0.012 | 0.41 | — | 0.15 | | Comparative example |

Formula (1): Ti + Nb + V
Formula (2): Co/B
Formula (3): Nb + V

TABLE 4

| No | Presence or absence of cracks in vicinity of weld zone | Presence or absence of corrosion in vicinity of weld zone | Irregularities on wall of specimen subjected to deep drawing | Remarks |
|---|---|---|---|---|
| 34 | ○ | ○ | ⊙ | Inventive example |
| 35 | ○ | ○ | ⊙ | Inventive example |
| 36 | ○ | ○ | ⊙ | Inventive example |
| 37 | ○ | ○ | ⊙ | Inventive example |
| 38 | ○ | ○ | ⊙ | Inventive example |

TABLE 4-continued

| No | Presence or absence of cracks in vicinity of weld zone | Presence or absence of corrosion in vicinity of weld zone | Irregularities on wall of specimen subjected to deep drawing | Remarks |
|---|---|---|---|---|
| 39 | ○ | ○ | ⊙ | Inventive example |
| 40 | ○ | ○ | ⊙ | Inventive example |
| 41 | ○ | ○ | ⊙ | Inventive example |
| 43 | ○ | ○ | ⊙ | Inventive example |
| 44 | ○ | ○ | ⊙ | Inventive example |

TABLE 4-continued

| No | Presence or absence of cracks in vicinity of weld zone | Presence or absence of corrosion in vicinity of weld zone | Irregularities on wall of specimen subjected to deep drawing | Remarks |
|---|---|---|---|---|
| 45 | ○ | ○ | ⊙ | Inventive example |
| 46 | ○ | ○ | ⊙ | Inventive example |
| 47 | ○ | ○ | Δ | Inventive example |
| 48 | ○ | ○ | Δ | Inventive example |
| 49 | ○ | ○ | Δ | Inventive example |
| 50 | ○ | ○ | Δ | Inventive example |
| 51 | ○ | ○ | Δ | Inventive example |
| 52 | ○ | ○ | Δ | Inventive example |
| 53 | ○ | ○ | Δ | Inventive example |
| 54 | ○ | ○ | Δ | Inventive example |
| 55 | ○ | ○ | Δ | Inventive example |
| 56 | ○ | ○ | Δ | Inventive example |
| 57 | ○ | ○ | Δ | Inventive example |
| 58 | ○ | ○ | Δ | Inventive example |
| 59 | ○ | ○ | Δ | Inventive example |
| 60 | ○ | ○ | Δ | Inventive example |
| 61 | ○ | ○ | Δ | Inventive example |
| 62 | × | × | Δ | Comparative example |

INDUSTRIAL APPLICABILITY

According to aspects of the present invention, a ferritic stainless steel which is suitable for use in a structure joined by welding after deep drawing and which is excellent in weld shape and corrosion resistance is obtained. The ferritic stainless steel obtained in accordance with aspects of the present invention is suitable for applications for manufacturing structures by welding after deep drawing, for example, applications such as electronic device parts including battery cases and automotive parts such as converters.

The invention claimed is:

1. A ferritic stainless steel having a composition containing,

C: 0.001% to 0.020%,
Si: 0.01% to 0.20,
Mn: 0.01% to 0.50%,
P: 0.04% or less,
S: 0.01% or less,
cr: 18.0% to 21.5%,
Ni: 0.01% to 0.40%,
Mc: 0.30% to 3.0%,
Al: 0.01% to 0.15%,
Ti: 0.01% to 0.50%,
Nb: 0.01% to 0.13%,
V: 0.01% to 0.50%,
Co: 0.01% to 6.00%,
B: 0.0002% to 0.0050%, and
N: 0.001% to 0.020% on a mass basis, the remainder being Fe and inevitable impurities, the composition satisfying the following formula:

$$0.30\% \leq Ti+Nb+V \leq 0.60\% \quad (1)$$

where the symbol of each element in Formula (1) represents the content mass percent of the element, wherein the ferritic stainless steel is free from irregularities, on a wall of a specimen subjected to deep drawing, in which the difference between a maximum peak height and a maximum valley depth is 200 μm or more on an arc with a diameter of 22 mm.

2. The ferritic stainless steel according to claim 1, wherein the content of Mo is 0.30% to 1.50%, the content of Ti is 0.25% to 0.40%,
the content of Nb is 0.03% to 0.13%,
the content of V is 0.02% to 0.13%,
the content of Co is 0.02% to 0.30%, and the following formulas are satisfied:

$$Co/B: 10 \text{ to } 150 \quad (2)$$

$$Nb+V \leq 0.22\% \quad (3)$$

where the symbol of each element in Formulas (2) and (3) represents the content (mass percent) of the element.

3. The ferritic stainless steel specified according to claim 2, wherein one or more of Zr: 1.0% or less,
W: 1.0% or less, and
REM: 0.1% or less is further contained on a mass basis.

4. The ferritic stainless steel specified according to claim 1, wherein one or more of Zr: 1.0% or less,
W: 1.0% or less, and
REM: 0.1% or less is further contained on mass basis.

5. The ferritic stainless steel specified according to claim 1, wherein the ferritic stainless steel displays no crack with a length of 0.5 mm or more in a vicinity of a weld zone, at a position 2-5 mm away from a fusion line, of a cylindrical deep drawing wall, observed at 200× magnification.

* * * * *